US006729525B2

(12) United States Patent
Chou

(10) Patent No.: US 6,729,525 B2
(45) Date of Patent: May 4, 2004

(54) STRUCTURE OF A TWO DIMENSIONAL POSITIONING NAILING MACHINE

(76) Inventor: Ammy Chou, 4th FL., No. 276, Sec. 1, Ta Tung Rd., Hsi Chih Town, Taipei Hsien (TW)

( * ) Notice: Subject to any disclaimer, the term of this patent is extended or adjusted under 35 U.S.C. 154(b) by 0 days.

(21) Appl. No.: 10/270,146

(22) Filed: Oct. 15, 2002

(65) Prior Publication Data

US 2003/0085252 A1 May 8, 2003

(30) Foreign Application Priority Data

Nov. 6, 2001 (TW) ..... 90219033 U

(51) Int. Cl.[7] ..... B25C 1/00

(52) U.S. Cl. ..... 227/140; 227/8; 227/156; 173/21; 33/452; 33/485

(58) Field of Search ..... 227/8, 15, 17, 227/140, 142, 150, 132, 156, 151, 154; 173/21, 20; 33/263, 452, 464, 483, 484, 485

(56) References Cited

U.S. PATENT DOCUMENTS 4,025,031 A * 5/1977 Chi ..... 227/132
4,113,404 A * 9/1978 Lippacher et al. ..... 408/241 S
4,257,166 A * 3/1981 Barker et al. ..... 408/241 G
5,052,112 A * 10/1991 MacDonald ..... 33/263
5,690,451 A * 11/1997 Thurler et al. ..... 408/113

* cited by examiner

*Primary Examiner*—Stephen F. Gerrity
*Assistant Examiner*—Thanh Truong
(74) *Attorney, Agent, or Firm*—Bacon & Thomas, PLLC

(57) ABSTRACT

An improved structure of a two dimensional positioning nailing machine is disclosed, which has a body, a positioning member and at least one positioning rule, the improved structure characterized in that the positioning member is removably attached on the body, the positioning member in an approximately reversed U shape having a first side portion, a second side portion and a head end; wherein the first side portion has an inner side and an outer side, and the second side portion has an inner side and an outer side, the outer side of the first side portion, the outer side of the second side portion and the head end having at least one positioning slot, the positioning rule capable of being inserted in the positioning slot to adjust a stroke to position distance.

7 Claims, 4 Drawing Sheets

STRUCTURE OF A TWO DIMENSIONAL POSITIONING NAILING MACHINE

BACKGROUND OF THE INVENTION

1. Field of the Invention

The present invention relates to an improved structure of a nailing machine and, more particularly, to an improved structure of a two dimensional positioning nailing machine.

2. Description of Related Art

In order to bind books or boards or other thin material, a nailing machine is often used.

R.O.C. patent application serial No. 79202566, No. 81109106, No. 83202193 and No. 86105985 all disclose a nailing machine in different type.

SUMMARY OF THE INVENTION

The objective of the present invention is to provide an improved structure of a two dimensional positioning nailing machine, which has a positioning member for inserting a positioning rule for one dimensional or two dimensional positioning.

Another objective is to provide an improved structure of a two dimensional positioning nailing machine with a positioning member, the positioning member has simple structure and operation.

To achieve these objectives, the improved structure of a two dimensional positioning nailing machine in the present invention, the positioning member is in an approximately reversed U shape and has a first side portion, a second side portion and a head end; wherein the first side portion has an inner side and an outer side, and the second side portion has an inner side and an outer side, the outer side of the first side portion, the outer side of the second side portion and the head end have at least one positioning slot, the positioning rule is capable of being inserted in the positioning slot to adjust a stroke to position distance.

Furthermore, the inner side of the first side portion and the inner side of the second side portion of the positioning member of the positioning member have at least one locking protuberance, and the locking protuberance can be fixed into a corresponding locking groove on the body.

Moreover, the surface of the positioning rule has a plurality of waved protuberances and distance graduations, the waved protuberances capable of locking in the locking groove to prevent the positioning rule from loosening machine.

The positioning slot of the head end portion of the positioning member, and the positioning slot of the outer side of the first side portion or the positioning slot of the outer side of the second side portion, are located at different horizontal levels, and when a plurality of positioning rules are simultaneously inserted in the positioning slot of the outer side of the first side portion or the positioning slot of the outer side of the second side portion, the plurality of positioning rules are staggered on different horizontal levels.

The head end portion of the positioning member has a single line positioning groove and a double line positioning groove. The single line positioning groove and a double line positioning groove can hold at least one wire or strip element.

Other objectives, advantages, and novel features of the invention will become more apparent from the following detailed description when taken in conjunction with the accompanying drawings.

DETAILED DESCRIPTION OF THE PREFERRED EMBODIMENT

Figure 1:
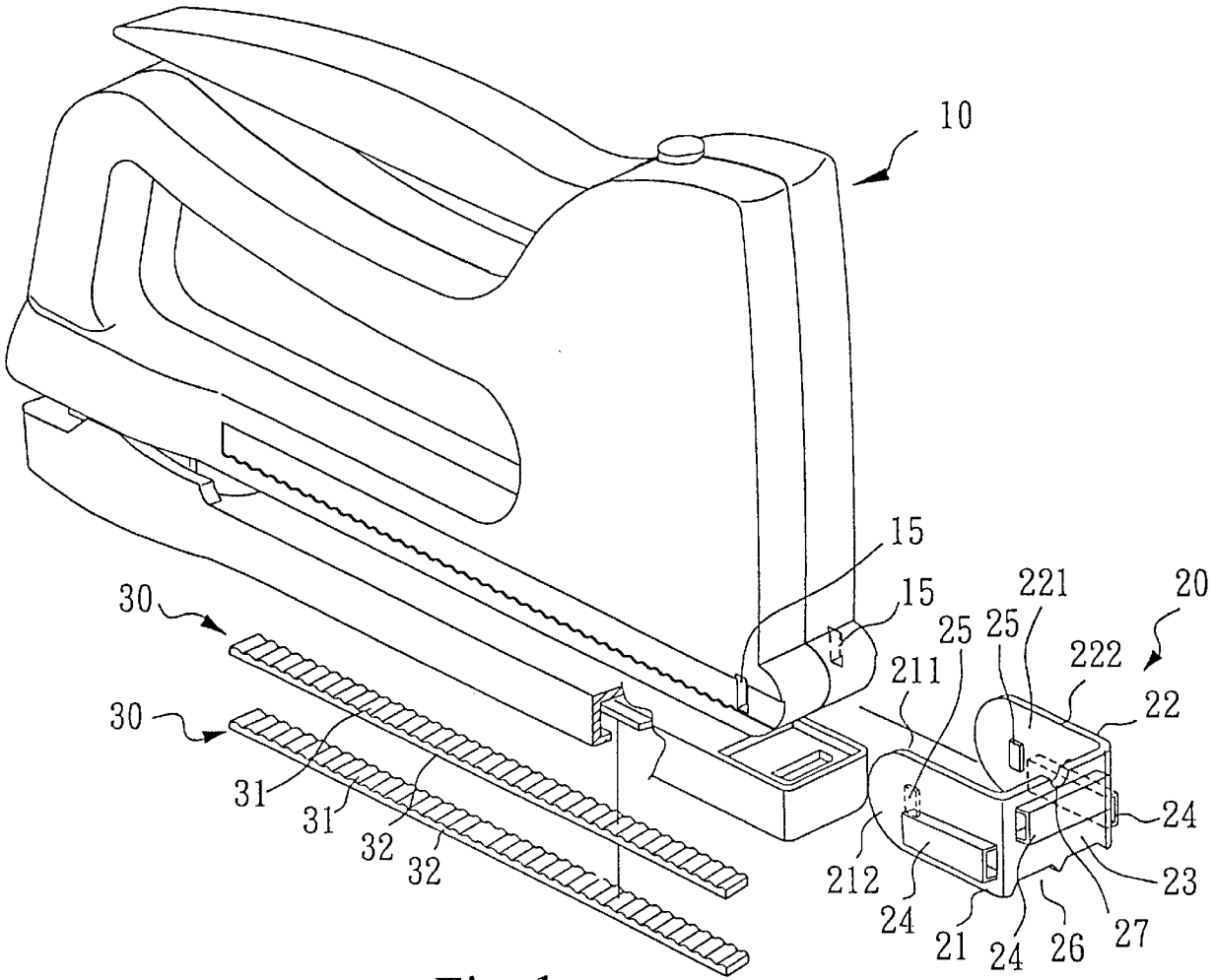
FIG. 1 is an exploding structure schematic drawing of a nailing machine according to the present invention.

Please refer to FIG. 1. An improved structure of a two dimensional positioning nailing machine of the present invention has a body 10, a positioning member 20 and at least one positioning rule 30, in FIG. 1, there are two positioning rules 30.

The positioning member 20 is in an approximately reversed U shape and has a first side portion 21, a second side portion 22 and a head end 23; wherein the first side portion 21 has an inner side 211 and an outer side 212, and the second side portion 22 has an inner side 221 and an outer side 222, the outer side 212 of the first side portion 21, the outer side 222 of the second side portion 22 and the head end 23 have at least one positioning slot 24, the positioning rule 30 is capable of being inserted in the positioning slot 24 to adjust a stroke to position distance.

The inner side 211 of the first side portion and the inner side of the second side portion of the positioning member have a plurality of locking protuberances 25. The body 10 of the nailing machine has a front end portion with a plurality locking grooves 15, and the locking protuberance 25 can be removably fixed into a corresponding locking groove 15 on the body 10.

Figure 2:
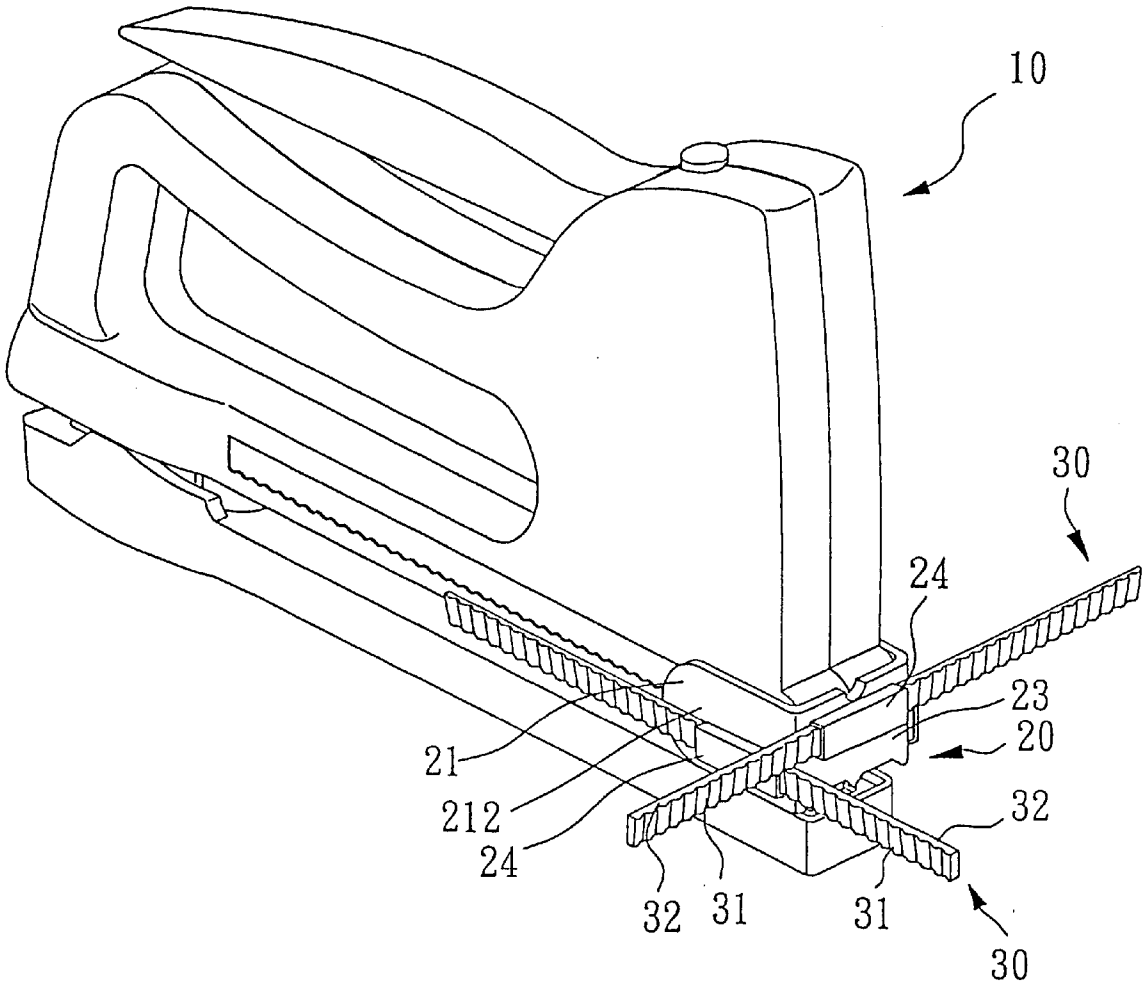
FIG. 2 is a schematic drawing of the nailing machine according to the present invention.

Please refer to FIG. 2. The outer side 21 of the first side 21 and the head end portion 23 of the positioning member 20 both have a positioning slot 24 respectively, and the positioning slots 24 are located at different horizontal levels. When two positioning rules 30 are simultaneously inserted in two positioning slots 24, the two positioning rules 30 are staggered on different horizontal levels to be perpendicular to each other for two-dimensional positioning.

The positioning rule 30 has a first side 31 and a second side 32, the first side has a plurality of waved protuberances and the second side 32 has a plurality of distance graduations.

When the positioning rule 30 is inserted in any one of the positioning slot 24, the waved protuberances the first side are capable of locking in the locking groove 24 to prevent the positioning rule from loosening machine, and the distance graduations of the second side 32 of the positioning rule 30 provides a one dimensional measure function for a user.

When the positioning rules 30 are simultaneously inserted in the positioning slot 24 of the head end portion 23 and the positioning slot 24 of the outer side 212 of the first side portion 21, two positioning rules 30 forms a right angle due to its own reversed U shape, and two positioning rules 30 are simultaneously inserted in two positioning slots 24 on different horizontal levels, for two dimensional positioning.

Figure 3:
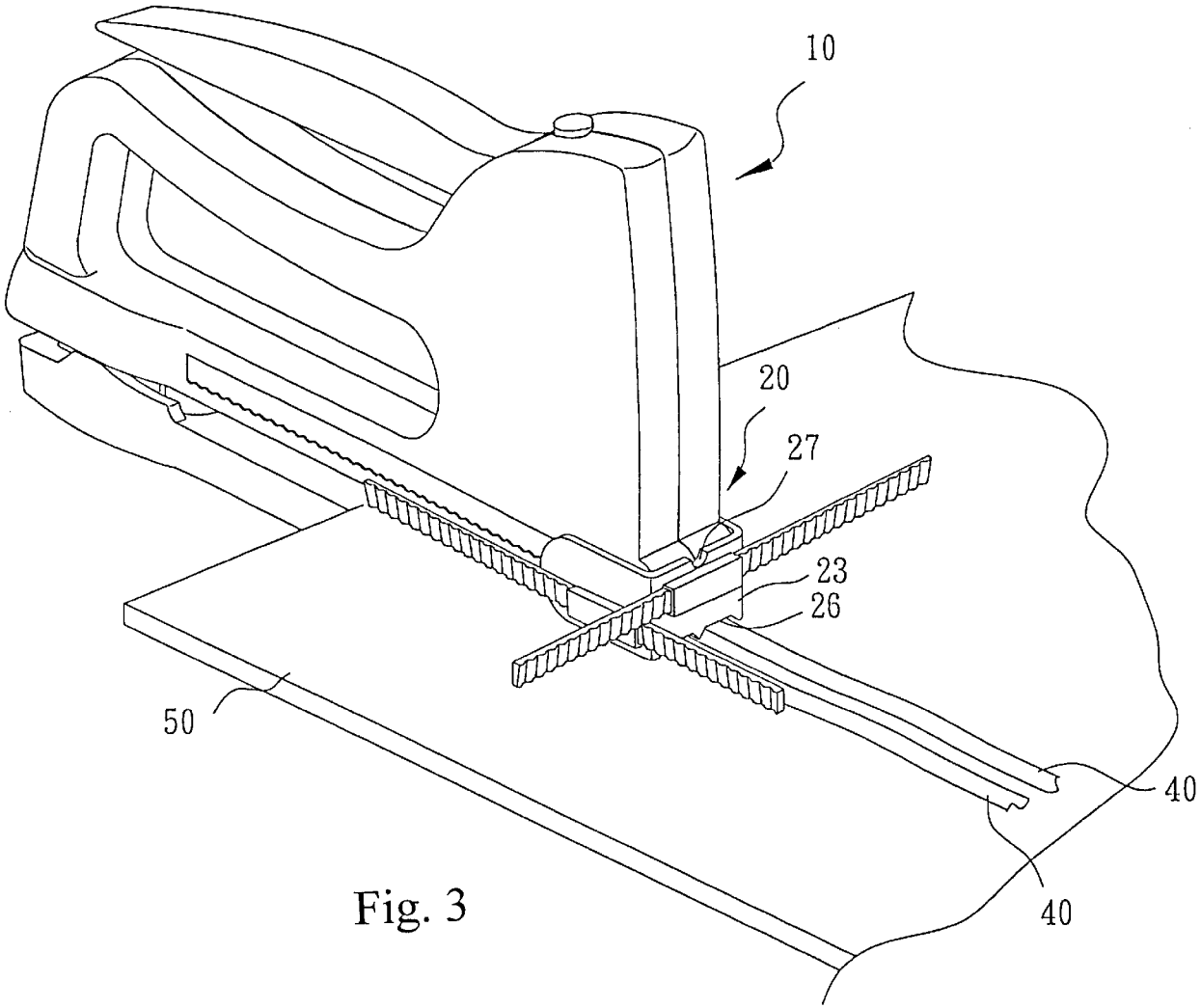
FIG. 3 is a schematic drawing of utilization of an embodiment according to the present invention.

Please refer to FIG. 3. The head end portion 23 of the positioning member 20 has a single line positioning groove 27 and a double line positioning groove 26. The double line positioning groove 26 tightly presses two strip shape materials 40, to fix two strip shape materials 40 on board 50.

Figure 4:
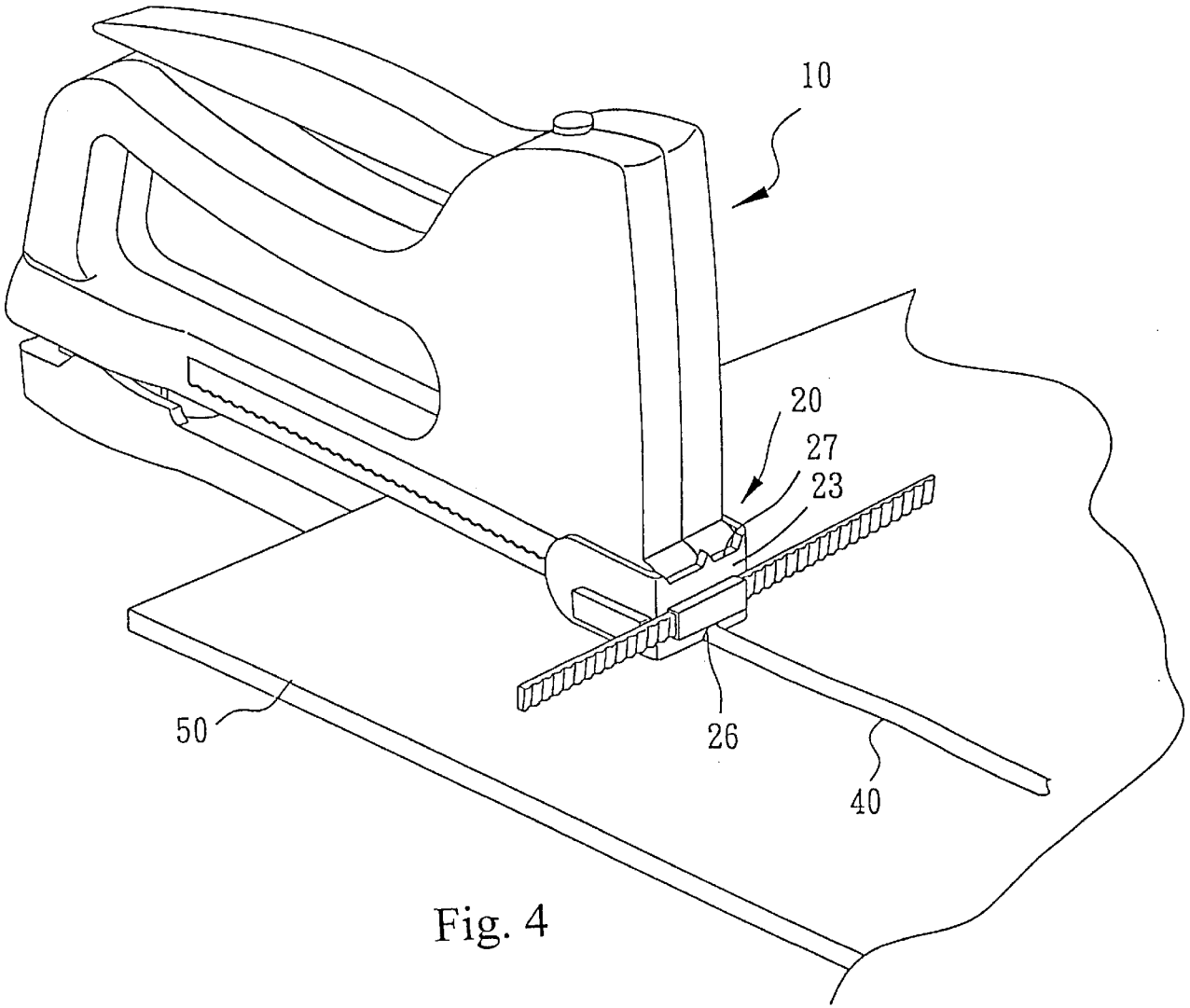
FIG. 4 is a schematic drawing of utilization of another embodiment according to the present invention.

Please refer to FIG. 4. The single line positioning groove 26 of the head end portion 23 of the positioning member 20 tightly presses one strip shape material 40, to fix one strip shape material 40 on board 50.

The invention has been described using exemplary preferred embodiments. However, for those skilled in this field the preferred embodiments can be easily adapted and modified to suit additional applications without departing from the spirit and scope of this invention. Thus, it is to be understood that the scope of the invention is not limited to the disclosed embodiments. On the contrary, it is intended to cover various modifications and similar arrangements based upon the same operating principle. The scope of the claims, therefore, should be accorded the broadest interpretations so as to encompass all such modifications and similar arrangements.

Although the present invention has been explained in relation to its preferred embodiment, it is to be understood that many other possible modifications and variations can be made without departing from the spirit and scope of the invention as hereinafter claimed.

What is claimed is:

1. An improved structure of a two dimensional positioning nailing machine having a body, a positioning member and at least one positioning rule, the improved structure characterized in that:

the positioning member is removably attached on the body, the positioning member in an approximately reversed U shape having a first side portion, a second side portion and a head end; wherein the first side portion has an inner side and an outer side, and the second side portion has an inner side and an outer side, the outer side of the first side portion, the outer side of the second side portion and the head end each having at least one positioning slot, the positioning rule capable of being inserted in one of the positioning slots to adjust a stroke to position distance.

2. The improved structure of a two dimensional positioning nailing machine as claimed in claim 1, wherein the inner side of the first side portion and the inner side of the second side portion of the positioning member have at least one locking protuberance, the nailing machine having a front end portion with at least two locking grooves, and each of the locking protuberances can be fixed into a corresponding locking groove on the body.

3. The improved structure of a two dimensional positioning nailing machine as claimed in claim 2, wherein the surface of the positioning rule has a plurality of waved protuberances and distance graduations, the waved protuberances capable of locking in the locking groove to prevent the positioning rule from loosening from the machine.

4. The improved structure of a two dimensional positioning nailing machine as claimed in claim 1, wherein the positioning slot of the head end of the positioning member, and the positioning slot of the outer side of the first side portion or the positioning slot of the outer side of the second side portion, are located at different relative levels, and when a positioning rule is inserted in the positioning slot of the head end, and a second positioning rule is inserted in one of either the positioning slot of the outer side of the first side portion or the positioning slot of the outer side of the second side portion, the two positioning rules are staggered on different relative levels.

5. The improved structure of a two dimensional positioning nailing machine as claimed in claim 1, wherein the head end of the positioning member has a single line positioning groove.

6. The improved structure of a two dimensional positioning nailing machine as claimed in claim 1, wherein the head end of the positioning member has a double line positioning groove.

7. The improved structure of a two dimensional positioning nailing machine as claimed in claim 1, wherein the head end portion of the positioning member has a single line positioning groove and a double line positioning groove.

* * * * *